US009259067B2

(12) United States Patent
Kruse

(10) Patent No.: US 9,259,067 B2
(45) Date of Patent: Feb. 16, 2016

(54) CARRYING APPARATUS

(75) Inventor: David Eugene Kruse, St. Anne, IL (US)

(73) Assignee: KRUSECREW, Inc., Saint Anne, IL (US)

( * ) Notice: Subject to any disclaimer, the term of this patent is extended or adjusted under 35 U.S.C. 154(b) by 303 days.

(21) Appl. No.: 13/486,346

(22) Filed: Jun. 1, 2012

(65) Prior Publication Data

US 2013/0320054 A1 Dec. 5, 2013

(51) Int. Cl.

| | |
|---|---|
| ***A45F 3/14*** | (2006.01) |
| ***A45F 3/02*** | (2006.01) |
| ***A62B 25/00*** | (2006.01) |
| ***A45C 3/00*** | (2006.01) |
| *A62C 8/00* | (2006.01) |
| *A45F 3/00* | (2006.01) |

(52) U.S. Cl.

CPC ..... *A45C 3/00* (2013.01); *A45C 2003/005* (2013.01); *A45C 2200/20* (2013.01); *A45F 3/02* (2013.01); *A45F 3/14* (2013.01); *A45F 2003/001* (2013.01); *A45F 2003/003* (2013.01); *A45F 2003/146* (2013.01); *A62B 25/00* (2013.01); *A62C 8/00* (2013.01)

(58) Field of Classification Search

CPC ..... A45C 2003/005; A45F 2003/142; A45F 3/02

USPC ..... 224/600, 609, 602

See application file for complete search history.

(56) References Cited

U.S. PATENT DOCUMENTS

| | | | | | |
|---|---|---|---|---|---|
| 747,681 | A | * | 12/1903 | Bradbury | 224/602 |
| 2,672,263 | A | | 3/1954 | Alber | |
| 2,813,602 | A | | 11/1957 | MacArthur | |
| D247,524 | S | * | 3/1978 | Graham | D3/231 |
| 4,336,899 | A | * | 6/1982 | Price, II | 224/609 |
| 4,438,764 | A | * | 3/1984 | Eppolito | A62B 9/04 128/204.18 |
| 4,442,960 | A | * | 4/1984 | Vetter | 224/417 |
| D292,847 | S | * | 11/1987 | Barker | D3/231 |
| 4,790,462 | A | | 12/1988 | Kawaguchi | |
| 4,804,218 | A | * | 2/1989 | Hilliard | B63C 11/22 294/157 |
| 4,979,659 | A | * | 12/1990 | Boyd | 224/603 |
| 5,129,560 | A | | 7/1992 | Herman | |
| 5,188,267 | A | | 2/1993 | Sargent et al. | |

(Continued)

FOREIGN PATENT DOCUMENTS

EP 0 526 417 A2 2/1993

OTHER PUBLICATIONS

Zico Air-Caddy Cylinder Carrying System, available at: http://www.firepenny.com/ProductDetails.asp?ProductCode=B1075, last viewed Mar. 21, 2012.

(Continued)

*Primary Examiner* — Justin Larson

(74) *Attorney, Agent, or Firm* — Beem Patent Law Firm

(57) ABSTRACT

A bag or pack for transporting material, which may include air tank bottles, rope, and/or other firefighting gear. The bag may be used in multiple different ways, but may be especially configured to rest on top of a primary air tank worn by the user and to avoid falling between that tank and the user's back. Pockets in the bag may allow the user to install bottles in an upright or inverted configuration, which may aid the user in quickly determining which bottles are usable. Bag may free up the user's hands, allowing him to carry extra gear and requiring further trips from a supply source to a staging area, which may be several floors up, e.g., in the case of a high rise environment.

17 Claims, 3 Drawing Sheets

(56) References Cited

U.S. PATENT DOCUMENTS

| | | | | | |
|---|---|---|---|---|---|
| 5,253,760 | A | * | 10/1993 | Miller | A62B 25/00 206/525 |
| D343,510 | S | * | 1/1994 | Langlois | D3/316 |
| 5,419,569 | A | | 5/1995 | Walla | |
| 5,511,846 | A | * | 4/1996 | Fuller | B63C 11/02 294/149 |
| 5,513,787 | A | | 5/1996 | Reed | |
| 5,540,188 | A | * | 7/1996 | Heinrichs | 119/770 |
| 5,628,436 | A | * | 5/1997 | Jones et al. | 224/148.3 |
| 5,785,223 | A | | 7/1998 | Matsushita | |
| 5,988,474 | A | | 11/1999 | Smith, II et al. | |
| D430,400 | S | * | 9/2000 | Harper | D3/316 |
| 6,135,333 | A | * | 10/2000 | Tucker et al. | 224/646 |
| D459,810 | S | | 7/2002 | Hetzel | |
| 6,446,849 | B1 | | 9/2002 | Schleifer | |
| 6,533,148 | B1 | | 3/2003 | Dahl | |
| 6,588,023 | B1 | * | 7/2003 | Wright | 2/459 |
| 6,869,219 | B1 | * | 3/2005 | Sala | 383/37 |
| D528,657 | S | * | 9/2006 | Adams | D24/128 |
| 8,302,830 | B1 | * | 11/2012 | Jensen | A45F 3/02 224/257 |
| D715,499 | S | * | 10/2014 | Schaede | D29/120.1 |
| 2003/0010343 | A1 | | 1/2003 | York | |
| 2004/0016785 | A1 | | 1/2004 | Timmons | |
| 2005/0053312 | A1 | * | 3/2005 | Hankins et al. | 383/4 |
| 2005/0274764 | A1 | * | 12/2005 | Fischel | 224/609 |
| 2005/0274765 | A1 | * | 12/2005 | Fischel | 224/609 |
| 2006/0060624 | A1 | * | 3/2006 | Duncan et al. | 224/602 |
| 2007/0272570 | A1 | * | 11/2007 | Brooks | 206/315.9 |
| 2008/0296325 | A1 | | 12/2008 | Tepper | |
| 2009/0159364 | A1 | | 6/2009 | O'Brien | |
| 2009/0159365 | A1 | | 6/2009 | O'Brien | |
| 2010/0012696 | A1 | * | 1/2010 | Prager | 224/417 |
| 2010/0024822 | A1 | | 2/2010 | Leon | |
| 2010/0147918 | A1 | * | 6/2010 | Hensley et al. | 224/600 |
| 2011/0017546 | A1 | * | 1/2011 | Nichols, Jr. | 182/3 |
| 2012/0152996 | A1 | * | 6/2012 | McDonald | 224/602 |

OTHER PUBLICATIONS

Fire Hooks Unlimited: "The Original" Extinguisher Harness, available at http://www.thefirestore.com/store/product.cfm?pID=5063, last viewed Mar. 21, 2012.

* cited by examiner

CARRYING APPARATUS

BACKGROUND OF THE INVENTION

1. Field of the Invention

The present invention relates to a storage device, such as a bag, for transporting equipment from one location to another.

2. Description of the Related Art

Previous methods for transporting gear, including self-contained breathing apparatus (SCBA) bottles, involved using webbing wrapped around the bottle tops, hauling a rope with the bottles attached to one or more rings, or manually carrying the bottles. The latter two methods can be cumbersome for the user, who often may be firefighting personnel. They also may require the use of the user's hands, which may prevent the user from carrying additional equipment, performing additional manual tasks, or doing something as simple as holding a handrail for support while climbing stairs.

In addition, while the first method may result in an apparatus that the user can carry without the use of hands, e.g., over a shoulder, it too has disadvantages. For example, the webbing may become tangled, requiring that the user spend time straightening it out instead of moving gear. Additionally, the webbing may become caught on the wearer's equipment, making it more difficult for the user to shed it if needed, or one some other structure such as a door handle, which may impede the user's progress, cause the user to lose his balance, or otherwise create a hazard for the user.

What is needed is a carrying apparatus that overcomes the drawbacks described above.

BRIEF SUMMARY OF THE INVENTION

In one embodiment, a bag may comprise: a plurality of pockets at opposing ends of a strap portion, the strap portion comprising a generally constant width portion having a first end and a second end, and a flared portion at each of the first and second ends; each of the pockets having an opening proximate a respective flared portion; wherein each pocket is at least about 6 inches in diameter and between about 12 inches and about 24 inches deep. The bag also may include at least one secondary pocket disposed alongside one of the plurality of pockets. At one end, at least one of the pockets may include a cinch closure, while at an opposite end, the pocket may include a grommeted opening.

The strap portion of the bag may include an enhanced thickness padding portion. The padding may be disposed within the generally constant width portion and may be about ¼" thick. The bag also may include a handle extending upward from the strap portion.

In another embodiment, a bag configured to carry one or more spare air bottles may comprise a strap portion extending from one end of the bag to another end, the strap portion joining a plurality of pockets and forming a portion of each of the pockets. The strap portion also may include an increased thickness portion disposed proximate a midpoint of the strap portion, the increased thickness portion including a compressible padding disposed within the strap portion. The bag also may include a handle disposed proximate a midpoint of the strap portion and a bendable strip coupled to each end of the handle, the strip disposed within the strap portion. In addition, the bag may include at least one opening in a bottom of at least one pocket. Moreover, the trap portion may include a generally constant width portion spanning a centerline of the bag, and a flared portion proximate an opening into at least one of the pockets.

The bag further may include at least one secondary pocket, where one of the primary pockets forms a portion of a wall of the secondary pocket. Additionally, the bag may include at least one grommet disposed between the plurality of pockets, which may allow the user to couple carabineers to the bag to carry additional equipment. The bag also may include reflective material disposed at various locations, e.g., on at least one of the strap portion and the plurality of pockets.

These and other features and advantages are evident from the following description of the present invention, with reference to the accompanying drawings.

DETAILED DESCRIPTION OF THE INVENTION

Figure 1:
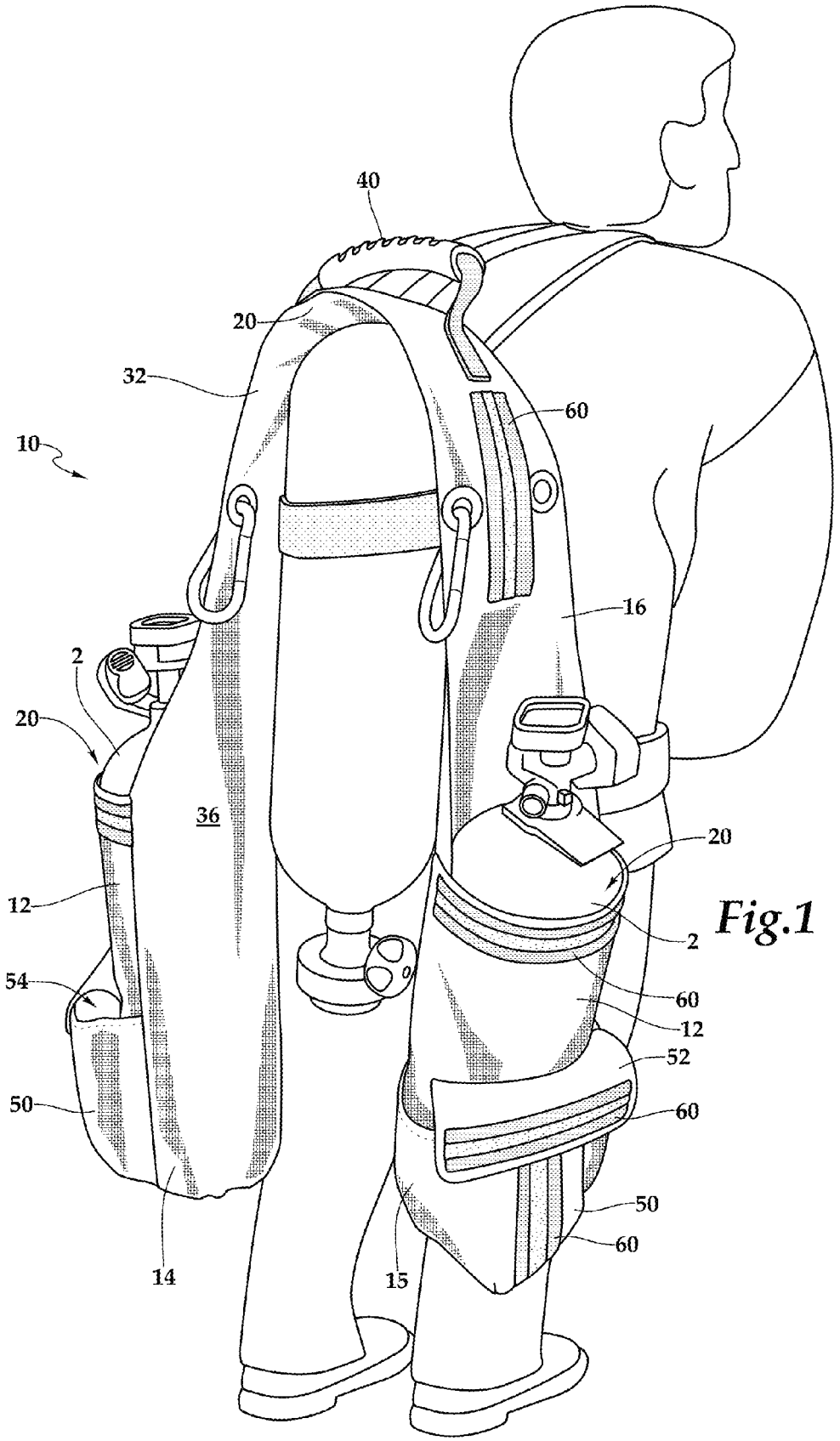
FIG. 1 is a perspective view of one embodiment of a bag for transporting equipment, shown in one method of use.
Figure 2:
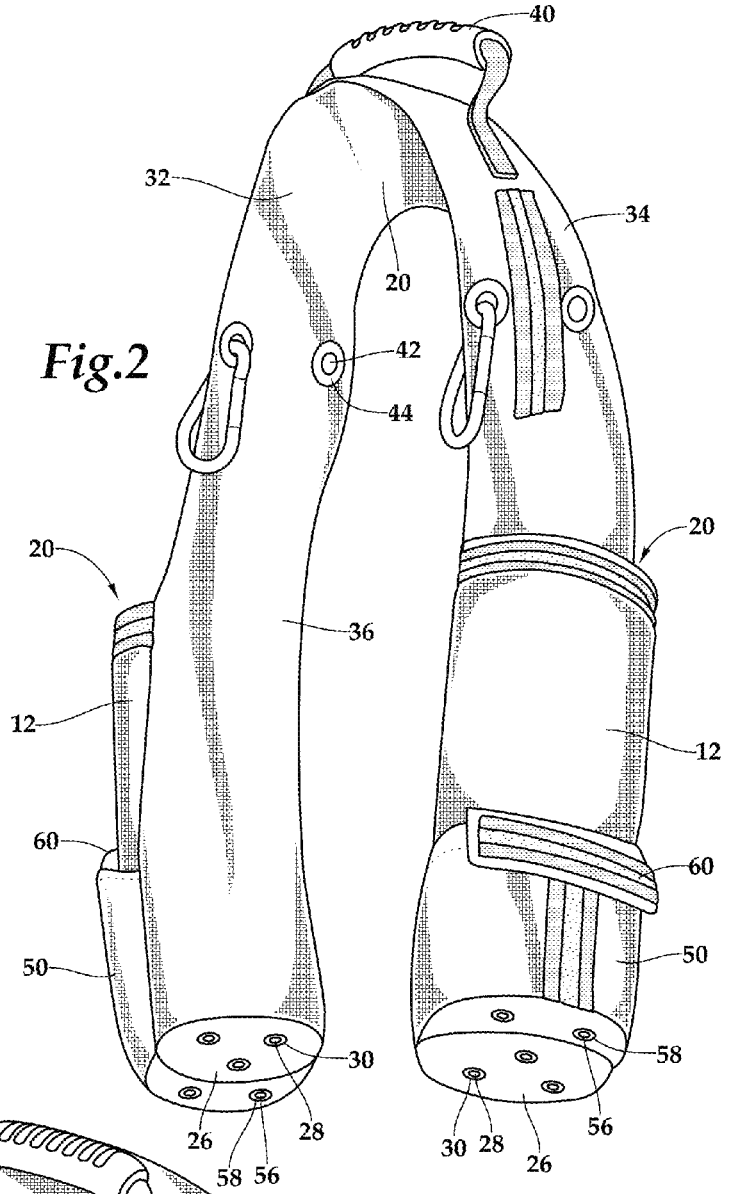
FIG. 2 is a bottom, perspective view of one side of the bag of FIG. 1.
Figure 3:
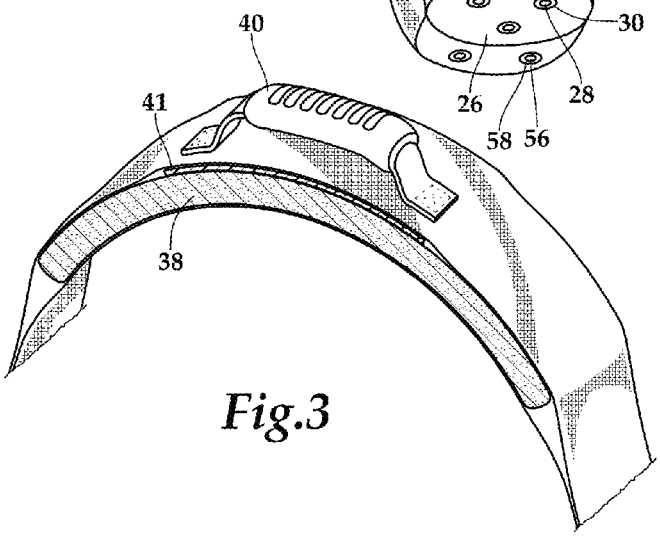
FIG. 3 is a centrally offset section view through an upper portion of the bag of FIG. 1.
Figure 4:
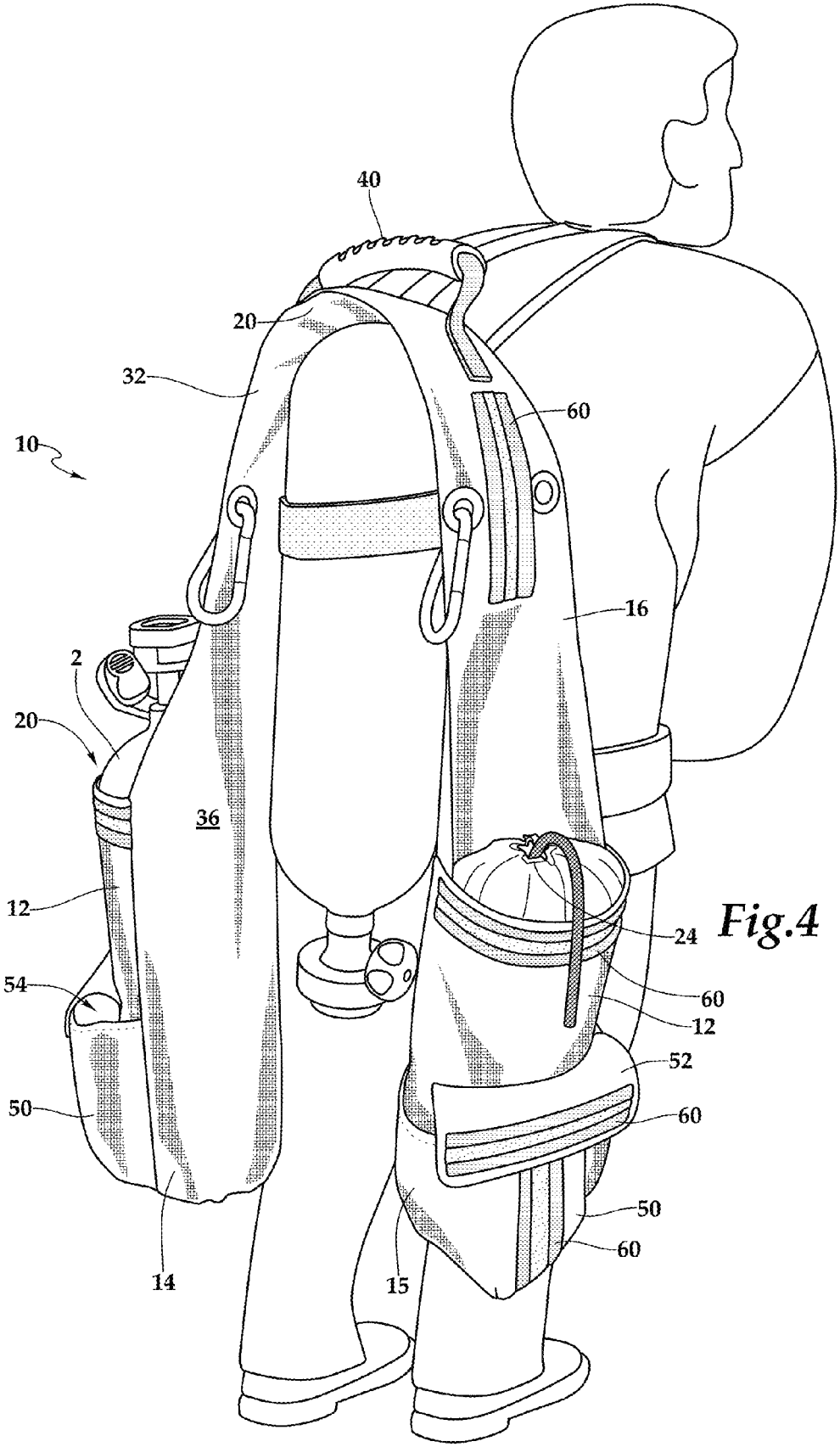
FIG. 4 is a perspective view of another embodiment of a bag for transporting equipment.

A bag or pack 10 for transporting SCBA air bottles 2 and other equipment. Bag may be particularly well-suited for use by firefighting personnel, e.g., in transporting bottles to and from an upper floor staging area in the event of a high rise fire.

Bag 10 may include at least one pouch or pocket 12 at an end 14, extending along outwardly facing side 16, with pocket opening 22 pointed upward or toward a center 20 of bag 10. Bag 10 may be substantially symmetrical, including having a plurality of pockets 12, which may include a pocket at each end 14, 15. In one embodiment, pockets 12 may be differently shaped or configured to receive different objects. Alternatively, however, pockets 12 may be similarly shaped.

Pockets 12 may be configured to store and transport various-sized air bottles. Typically, bottles are sized according to the amount of air they can hold, e.g., 30 minute, 45 minute, and 60 minute bottles. Bottles 2 may be generally cylindrical, and longer-lasting bottles may have larger diameters than shorter-lasting bottles. Additionally or alternatively, longer-lasting bottles may be taller than shorter-lasting alternatives. As such, pockets for longer-lasting bottles may be wider and/or deeper than pockets for bottles with smaller air capacities. Preferably, pockets 12 may have diameters proximate openings 22 slightly larger than the diameter of the largest bottle that each pocket 12 is designed to carry. Pockets 12 also preferably have a depth smaller than a height of the bottle stored within the pocket, allowing bottle 2 to protrude outward from a pocket opening 22.

As discussed above, pockets 12 may vary in width and/or depth depending on the size of the bottles designed to fit within pockets 12. For example, a pocket designed to hold a 30 minute bottle may be about 9 inches in diameter and about 16 inches deep. A pocket designed to hold a 45 minute bottle may be about 10½ inches in diameter and about 16 inches deep. And a pocket designed to hold a 60 minute bottle may be about 10½ in diameter and about 19 inches deep. In general pockets may be at least about 6 inches in diameter and between about 12 inches and about 24 inches deep.

In contrast to harness or strap-type carriers, configuration of pockets 12 permits a user to place and store a bottle 2 in either an upright or inverted configuration. This flexibility may allow the user to store full bottles in one configuration and empty bottles in another configuration, e.g., full cylinders may have their valves pointed upwards while empty cylinders may be upside-down. As such, bag 10 provides a rapid, visual method of determining which bottles are usable and which are not and the ability to quickly insert or remove bottles.

In one embodiment, opening 22 into pocket 12 may be unimpeded, i.e., there may be no cover or closure to pocket 12. As such, it may be easier to insert and/or remove bottles 2. Due to sizing of pocket diameter proximate opening 22, bottles 2, therefore may be securely stowed inside pockets while being substantially prevented from moving around within pockets. In another embodiment, one or more pockets 12 may include a cinch-type closure 24 proximate opening 22. Cinch closure 24 may assist in securing bottles that are significantly smaller than opening 22, thereby maintaining secure engagement of the bottle within pocket 12. Alternatively, cinch closure may permit the user to close opening 22 less than completely. This configuration may allow the user to use the pocket to store and disperse rope In one embodiment, one or more of pockets 12 may have a substantially constant cross-section along a substantial majority of its length, i.e., neither significantly flaring nor tapering with the exception of areas proximate opening 22 or base 26. In another embodiment, one or more of pockets 12 may have an expanding cross-section along its length, have a larger diameter at its base 26 than at its opening 22.

Pockets 12 further may include one or more openings 28, preferably disposed within base 26. Openings 28 may be surrounded by grommets 30 and may permit for drainage of water or other liquids that may enter pockets.

Bag 10 may include additional pockets 50, which may extend outward from pockets 12. Pockets 50 preferably are shallower than pockets 12, e.g., between about ¼ and about ¾, and in one embodiment about ½ as tall as pockets 12.

Pockets 50 may include some type of sealing or closing structure 52, e.g., cover flaps, zippers, cinch closures, etc. Flaps also may use couplers such as Velcro, buttons, etc., to assist in keeping flaps closed. As seen in FIG. 1, closing structure 52 may be a flap that extends over at least a part of an opening 54 to pocket 50. This configuration may allow for storage of objects within pockets 50 while permitting longer objects to extend beyond pocket opening 54.

As with pockets 12, secondary pockets 50 also may include one or more openings 56 at bottoms of pockets 50. Openings 56 may be surrounded by grommets 58, and may permit drainage of pockets 50.

Strap portion 32 may extend between pockets 12 or, alternatively, may extend from one end of the bag to the other, and may form an inward portion of pockets 12. Strap portion 32 may include a first portion 34 having a generally constant width that expands to one or more second or flared portions 36, each flared portion 36 disposed proximate pockets 12.

First portion 34 may have a width between about 3" and about 6", and in one embodiment, about 4½". Width of first portion 34 may be selected to provide sufficient surface area and frictional engagement between inwardly facing side 18 and a wearer's primary air tank during use so that pack 10 may remain in a desired position until removed at a desired location.

A typical user may wear pack 10 when climbing stairs, e.g., in a high rise or other building fire where access to elevators has been shut down and where it may be necessary to have spare air bottles readily and quickly available. This user may be carrying a substantial amount of gear and may be wearing a harness to carry a primary air tank on the middle of the user's back. The location of the primary tank on the user's back may prevent the user from wearing another harness or standard backpack.

In addition, the primary tank typically is inverted and has a rounded bottom pointing upwards, which may pose several problems to the user attempting to carry additional gear. For example, the rounded bottom may not be conducive to storing items on top of the tank, as they may have a tendency to slide along the rounded surface and off of the tank. Additionally, a gap may exist between this tank bottom and the user's back, which may become a valley into which objects may fall. This problem may be exacerbated by the user's body positioning during use, e.g., a user climbing stairs may lean forward, making it easier for objects to fall into that valley. Because the user may be faced with the need to act quickly and decisively at a moment's notice, it may be desirable to avoid objects falling into this valley, which then may become more difficult and/or time consuming to remove.

As such, first portion 34 also may include additional padding 38 as compared to a remainder of strap portion 32. Padding may be external, but preferably is disposed within first portion 34. Padding may be between about ⅛" and about 1" thick, preferably between about ⅛" and about ½" thick, and in one embodiment, about ¼" thick.

Compression of padding 38 may increase frictional engagement with the primary tank and may prevent the strap 14 from sliding between the wearer and the primary tank. Padding 38 further may be useful in the event that pack 10 is carried over a user's shoulder and/or neck.

In addition, first portion 34 further may include a handle 40, preferably generally equally spaced from each pocket 12. Handle 40 may be used to lift bag 10 off the wearer, e.g., by pulling away from the wearer when first portion 34 rests on top of the primary tank or by elevating the first portion 34 above and away from the primary tank, should the first portion 34 fall between the tank and the user. Handle 40 further may be useful to lift bag 10 into place on the user, to drag bag 10, or to serve as an additional means for carrying bag 10.

Bag 10 further may include reinforcing material such as a strip 41 to assist in securing handle 40 to strap portion 32. Strip 41 may extend underneath a surface of first portion 34 at one or more locations where handle 40 couples to first portion 34 and may provide an additional surface to which handle 40 may be coupled, e.g., via stitching, rivets, or some other type of fastening.

As such, bag 10 may be removed quickly and easily when the wearer reaches a desired location or if the wearer quickly needs to shed the extra equipment.

Strap portion 32 additionally may include at least one, and preferably a plurality, of openings 42. Openings 42 may be surrounded by grommets 44 and may be sized to accommodate carabineers, clamps, hooks, or other types of coupling devices, which may be used to couple additional tools or equipment to pack 10. Openings may be disposed along first portion 34, proximate a transition to flared portions 36, which may allow for passage of carabineers through openings 42 while minimizing or avoiding interference with storage and retrieval of bottles in pockets 12.

Pack 10 may include reflective material 60 to enhance visibility. In this context, retroreflective materials also should be considered to be reflective materials. Reflective material 60 may be positioned at one or more locations on pack, e.g., along strap portion 32, pockets 12, pockets 50, and/or covers 52. In particular, reflective material proximate opening 22 into pocket 12 may assist the user in locating opening 22, which may be beneficial if the user needs to insert or remove a bottle in conditions with decreased visibility. Reflective material on pockets 50 and covers 52 may serve a similarly beneficial purpose for locating and using pockets 50. Similarly, reflective material on strap portion 32 may assist the user in locating handle 40. Reflective materials also may beneficial in helping other people locate the wearer of pack 12.

Back 10 may be between about 40 inches and about 90 inches long, preferably between about 50 inches and about 75 inches long, and in one embodiment, about 65 inches long.

Second pockets 50 may be between about 4 inches and about 12 inches deep, preferably about 9 inches deep.

Bag 10 may be made of a vinyl- or canvas-type material, preferably fire resistant and/or fire retardant, although other materials also are possible.

While the foregoing written description enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A carrying apparatus for one or more SCBA bottles having an outwardly facing side and two ends and a predetermined length, comprising:

a strap having a generally constant width portion with a first end and a second end, and a flared portion at each of said first and second ends;

wherein said generally constant width portion has a width between about 3 inches and about 6 inches;

a pair of SCBA cylinder-configured pockets, each extending along said outwardly facing side, one at each end of said apparatus;

each of said pockets has an opening proximate a respective flared portion, each opening pointing toward a center of said apparatus;

wherein each pocket is at least about 6 inches in diameter and has a predetermined depth of between about 12 inches and about 24 inches and has a substantially constant cross-section;

wherein each pocket is sized according to the dimensions of a selected SCBA bottle such that the SCBA bottle is securely stowed and substantially prevented from moving within the pocket;

wherein said predetermined depth of each pocket is selected so that when carrying a corresponding selected SCBA bottle, having a valve in an upright position, said valve will protrude from said opening; and wherein said predetermined length of said carrying apparatus is between about 50 inches and about 75 inches.

2. A carrying apparatus according to claim 1, further comprising:

at least one secondary pocket; each said secondary pocket being disposed alongside a corresponding pocket of said pair of SCBA cylinder-configured pockets;

wherein each of said SCBA cylinder-configured pockets forms a wall of said secondary pocket, and said secondary pocket extends outwards from said SCBA cylinder-configured pocket;

wherein each of said secondary pockets has a closing structure extending over at least part of an opening to said secondary pocket; and wherein each of said secondary pockets is between about 4 inches and about 12 inches deep.

3. A carrying apparatus according to claim 1, further comprising:

an opening through a bottom of at least one of said SCBA cylinder-configured pockets.

4. A carrying apparatus according to claim 3, wherein said opening through a bottom of at least one of said pockets is surrounded by a grommet.

5. A carrying apparatus according to claim 1, wherein said generally constant width portion of said strap has an enhanced thickness padding.

6. A carrying apparatus according to claim 5, wherein said enhanced thickness padding is about ¼" thick.

7. A carrying apparatus according to claim 1, wherein an opening into at least one of said SCBA cylinder-configured pockets includes a cinch closure.

8. A carrying apparatus according to claim 1, further comprising:

a handle extending upward from said strap, disposed proximate a midpoint of said strap.

9. A carrying apparatus according to claim 1, wherein said apparatus is substantially symmetrical.

10. A carrying apparatus, having an outwardly facing side and two ends and a predetermined length, configured to carry one or more SCBA bottles, comprising:

a strap extending from one end of said carrying apparatus to another end, having a generally constant width portion with a first and second end, and a flared portion at each of said first and second ends;

wherein said strap further includes an increased thickness portion disposed proximate a midpoint of said strap;

a pair of SCBA cylinder-configured pockets, each pocket extending along said outwardly facing side of said carrying apparatus, one at each end of said apparatus;

wherein each of said pockets has an opening proximate a respective flared portion, each opening pointing toward a center of said apparatus;

wherein each of said pockets is at least about 6 inches in diameter and has a predetermined depth of between about 12 inches and about 24 inches deep and has a substantially constant cross section; wherein each pocket is sized according to the dimensions of a selected SCBA bottle such that the SCBA bottle is securely stowed and substantially prevented from moving within the pocket;

said strap forming an inward portion of each of said pockets; and said length of said carrying apparatus being between about 50 inches and about 75 inches.

11. A carrying apparatus according to claim 10, further comprising a handle extending upward from said strap, disposed proximate a midpoint of said strap.

12. A carrying apparatus according to claim 10, wherein said increased thickness portion of said strap includes a compressible padding disposed within said strap, wherein said padding has a width between about 3 inches and about 6 inches.

13. A carrying apparatus according to claim 12, wherein each of said pockets has a generally unimpeded opening; wherein said predetermined depth of each pocket is selected so that when carrying a corresponding selected SCBA bottle, having a valve, in an upright position, said valve will protrude from said unimpeded opening.

14. A carrying apparatus according to claim 10, further comprising at least one opening in a bottom of at least one SCBA cylinder-configured pocket.

15. A carrying apparatus according to claim 10, further comprising at least one secondary pocket, each said secondary pocket being disposed alongside a corresponding pocket of said pair of SCBA cylinder-configured pockets;

wherein each one of said SCBA cylinder-configured pockets forms a portion of a wall of the said secondary pocket and said secondary pocket extends outwards from said SCBA cylinder-configured pocket;

wherein said secondary pocket has a closing structure extending over at least part of an opening to said secondary pocket; and wherein each of said secondary pockets is between about 4 inches and 12 inches deep.

16. A carrying apparatus according to claim 10, further comprising at least one grommet disposed between said SCBA cylinder-configured pockets on said strap.

17. A carrying apparatus according to claim 10, further comprising reflective material disposed on one or more locations on said apparatus, including said strap, said pocket closures, and said pockets.

* * * * *